US006786196B2

(12) United States Patent
Nakano et al.

(10) Patent No.: US 6,786,196 B2
(45) Date of Patent: Sep. 7, 2004

(54) FUEL INJECTION QUANTITY CONTROL DEVICE

(75) Inventors: Futoshi Nakano, Fujisawa (JP); Koichiro Yomogida, Fujisawa (JP); Yuji Sasaki, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/757,811

(22) Filed: Jan. 15, 2004

(65) Prior Publication Data

US 2004/0144362 A1 Jul. 29, 2004

(30) Foreign Application Priority Data

Jan. 16, 2003 (JP) ..... 2003-008495

(51) Int. Cl.[7] ..... F02M 7/00
(52) U.S. Cl. ..... 123/344; 123/319
(58) Field of Search ..... 123/319, 344, 123/395, 294, 352

(56) References Cited

U.S. PATENT DOCUMENTS 4,860,707 A * 8/1989 Ohata ..... 123/339.2
4,977,881 A * 12/1990 Abe et al. ..... 123/674
6,092,504 A * 7/2000 Barnes et al. ..... 123/357

FOREIGN PATENT DOCUMENTS

JP 59-229020 12/1984
JP 04-134155 5/1992
JP 11-093747 4/1999

* cited by examiner

*Primary Examiner*—Bibhu Mohanty
(74) *Attorney, Agent, or Firm*—McCormick, Paulding & Huber LLP

(57) ABSTRACT

A fuel injection quantity control device for controlling an actual revolution speed En of an engine to a target revolution speed Eo, comprises difference computation unit for subtracting the actual revolution speed En from the target revolution speed Eo and finding the difference e therebetween; proportional term computation unit for multiplying the aforesaid difference e by the prescribed proportionality constant Kp and finding a proportional term output value Qp; integral term computation means for finding an integral term output value Qi which is obtained by integrating the product of the aforesaid difference e and the prescribed integration constant Ki; differential term computation unit for finding a differential term output value Qd which is obtained by multiplying the value obtained by differentiating the aforesaid difference e by the prescribed differentiation constant Kd; and injection quantity computation unit for adding up the proportional term output value Qp and the integral term output value Qi and determining the injection quantity.

20 Claims, 4 Drawing Sheets

FUEL INJECTION QUANTITY CONTROL DEVICE

CROSS REFERENCE TO RELATED APPLICATION

Applicants hereby claims foreign priority benefits under U.S.C § 119 of Japanese Patent Application No. 2003-8495, filed on Jan. 16, 2003, and the content of which is herein incorporated by reference.

BACKGROUND OF THE INVENTION

1. Field of the Invention

The present invention relates to a fuel injection quantity control device which is capable of suppressing overshoot and undershoot when the actual revolution speed of an engine is controlled to the target revolution speed.

2. Description of the Related Art

When the actual revolution speed (rpm) of an engine is controlled to the target revolution speed (rpm), the control is conducted so as to increase or decrease the fuel injection quantity. The inventors are presently developing the following procedure for computing the fuel injection quantity.

This procedure comprises the steps of finding a difference e by subtracting the actual revolution speed from the target revolution speed, finding the proportional term output value ($Qp=Kp\cdot e$) by multiplying the difference e by the prescribed proportionality constant Kp, finding the integral term output value ($Qi=\int(Ki\cdot e)dt$) by integrating the product of difference e and the prescribed integration constant Ki, and obtaining the final injection quantity by adding up those proportional term output value Qp and integral term output value Qi. With this procedure, because not only the proportional term output value Qp but also the integral term output value Qi is used, the speed response is good.

Japanese Patent Application Laid-open No. H4-134155 is known as a reference relating to pertinent conventional technology.

However, with the above-described procedure, for example, when the actual revolution speed is brought up to the target revolution speed, that is when the difference is positive, the difference is continued to be added up in the process for computing the integral term output value till the difference between the two speeds becomes 0. Therefore, in the point of time at which the difference becomes 0, the fuel injection quantity can become too large causing overshoot (the actual revolution speed is above the target revolution speed).

Conversely, when the actual revolution speed is brought down to the target revolution speed, that is, when the difference is negative, the difference is continued to be subtracted in the process for computing the integral term output value till the difference between the two speeds becomes 0. Therefore, in the point of time at which the difference becomes 0, the fuel injection quantity can become too small causing undershoot (the actual revolution speed is less than the target revolution speed).

SUMMARY OF THE INVENTION

It is an object of the present invention, which was created with the foregoing in view, to provide a fuel injection quantity control device which is capable of suppressing overshoot and undershoot when the actual revolution speed of an engine is controlled to the target revolution speed.

In order to attain the above-described object, the present invention provides a fuel injection quantity control device for controlling an actual revolution speed of the engine to a target revolution speed, comprising: difference computation means for subtracting the actual revolution speed from the target revolution speed and finding the difference therebetween; proportional term computation means for multiplying the aforesaid difference by the prescribed proportionality constant and finding a proportional term output value; integral term computation means for finding an integral term output-value which is obtained by integrating the product of the aforesaid difference and the prescribed integration constant; differential term computation means for finding a differential term output value which is obtained by multiplying the value obtained by differentiating the aforesaid difference by the prescribed differentiation constant; and injection quantity computation means for adding up the aforesaid proportional term output value and integral term output value and determining the injection quantity, wherein the device further comprises correction means for limiting the lower limit of the integral term output value with the differential term output value when the aforesaid difference is negative, thereby suppressing the excess reduction of the injection quantity, and limiting the upper limit of the integral term output value with the differential term output value when the difference is positive, thereby suppressing the excess increase of the injection quantity.

With the fuel injection quantity control device in accordance with the present invention, when the actual revolution speed of the engine is controlled to the target revolution speed, overshoot and undershoot can be suppressed. Thus, limiting the lower limit of the integral term output value Qi with the differential term output value Qd suppresses undershoot, and limiting the upper limit of the integral term output value Qi with the differential term output value Qd suppresses overshoot.

DESCRIPTION OF THE PREFERRED EMBODIMENTS

The preferred embodiments of the present invention will be described hereinbelow with reference to the appended drawings.

The fuel injection quantity control device of the present embodiment controls the actual revolution speed En of an engine (diesel engine or the like) to the target revolution speed Eo and is used, for example, for revolution speed matching of semiautomatic transmissions in which manual shifting is made by mechanical operations or fully automatic transmissions and for idling control.

Figure 1:
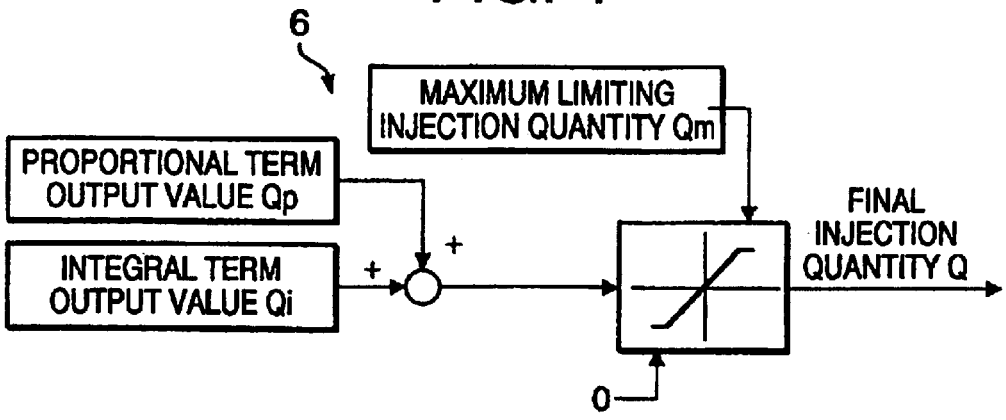
FIG. 1 is an explanatory drawing illustrating schematically the fuel injection quantity control device of an embodiment of the present invention.

As shown in FIG. 1, this fuel injection quantity control device comprises injection quantity computation means 6 for adding up the below-described proportional term output value Qp and integral term output value Qi implementing the lower limit limitation of a zero injection quantity and the upper limit limitation of a maximum limit injection quantity Qm with respect thereto, and obtaining a final injection quantity Q. Thus, this injection quantity control device is based on proportional integral control (PI control).

Figure 2:
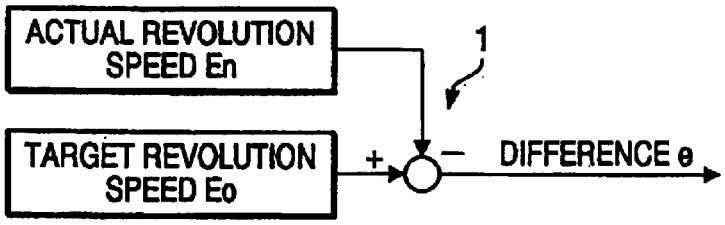
FIG. 2 is an explanatory drawing illustrating difference computation means.

The fuel injection quantity control device, as shown in FIG. 2, comprises difference computation means 1 for subtracting the actual revolution speed En from the target revolution speed Eo and finding the difference e. The target revolution speed Eo is set to a revolution speed (rpm) appropriately set by a computer during the above-mentioned revolution speed matching of a transmission or to an idling revolution speed (rpm). Furthermore, the actual revolution speed En is obtained with a rotation sensor which measures the revolution speed (rpm) of a crankshaft.

Figure 3:
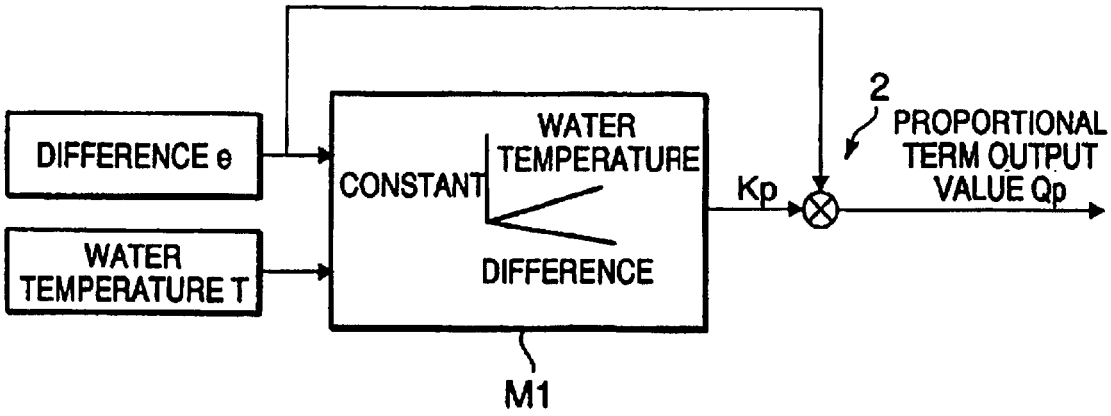
FIG. 3 is an explanatory drawing illustrating proportional term computation means.

The fuel injection quantity control device, as shown in FIG. 3, comprises proportional term computation means 2 for multiplying the difference e by the prescribed proportionality constant Kp and finding a proportional term output value Qp ($Qp=Kp\cdot e$). The proportionality constant Kp is determined based on a map M1 from the difference e and a water temperature T. The water temperature T is obtained with a water temperature sensor which measures the temperature of cooling water.

Figure 4:
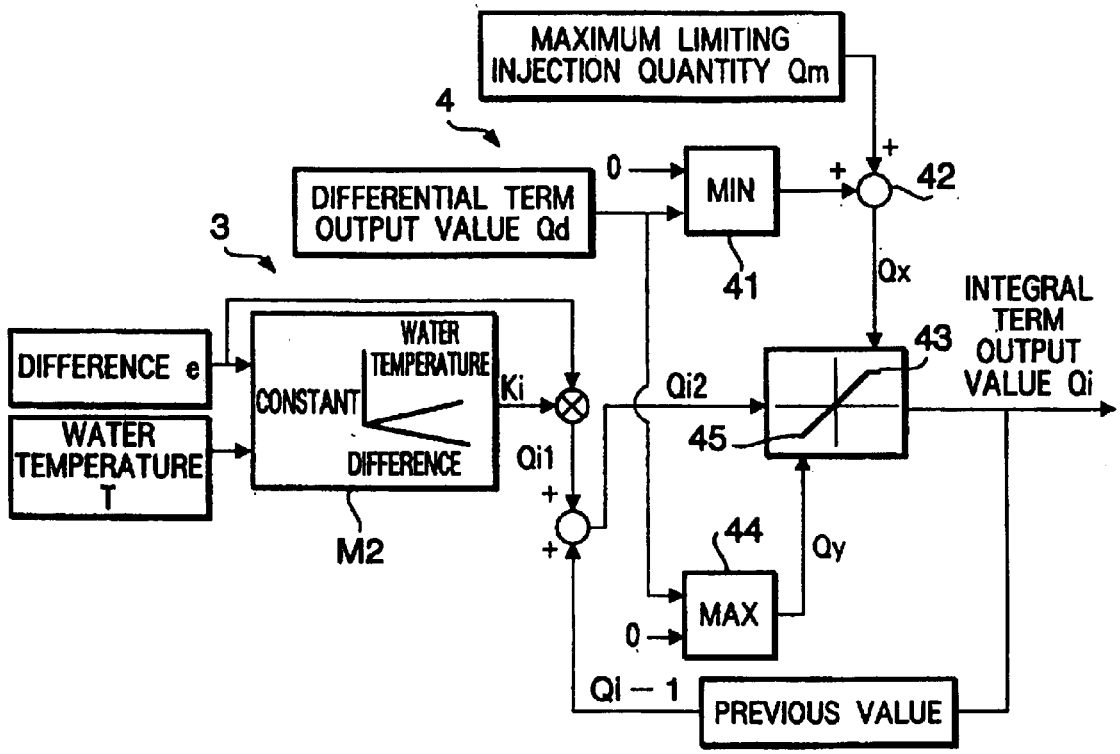
FIG. 4 is an explanatory drawing illustrating integral term computation means.

The fuel injection quantity control device, as shown in FIG. 4, comprises integral term computation means 3 for finding an integral term output value Qi which is obtained by integrating the product of the difference e and the prescribed integration constant Ki ($Qi=\int(Ki\cdot e)dt$). The integration constant Ki is determined based on a map M2 from the difference e and water temperature T. The maximum and minimum values of the integral term output value Qi are limited by the below described correction means 4.

Figure 5:
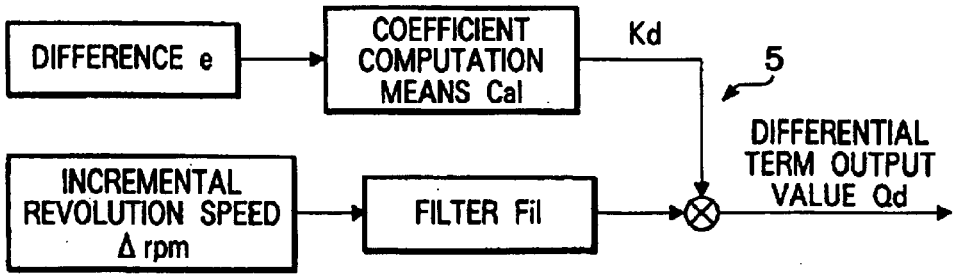
FIG. 5 is an explanatory drawing illustrating differential term computation means.

The fuel injection quantity control device, as shown in FIG. 5, comprises differential term computation means 5 for finding a differential term output value Qd which is obtained by multiplying the value obtained by differentiating the difference e by the prescribed differentiation constant Kd ($Qd=d/dt(Kd\cdot e)$). The differentiation constant Kd is computed by imputing the difference e into coefficient computation means Ca1, and the differential value of the difference e is computed by inputting an incremental revolution speed Δrpm into a filter Fi1. The differential term output value Qd is then found by multiplying the computed values.

Correction means 4, as shown in FIG. 4, limits the lower limit of the integral term output value Qi with the differential term output value Qd when the difference e is negative, thereby suppressing the excess decrease in the injection quantity, and limits the upper limit of the differential term output value Qi with the differential term output value Qd when the difference e is positive, thereby suppressing the excess increase in the injection quantity.

Thus, integral term computation means 3 and correction means 4, first, find an addition value Qi2 by adding up an output value Qi1 obtained by multiplying the difference e by the prescribed integration constant Ki and the previous integral term output value Qi−1. The lower limit of the addition value Qi2 is then limited by a larger (lower limit value Qy) of the differential term output value Qd and 0 and the excess decrease in the injection quantity is suppressed. As a result, undershoot is prevented.

More specifically, correction means 4 comprises a selection unit 44 for selecting the larger of the differential term output value Qd and 0 and a lower limit limiter 45 for limiting the lower limit of the integral term output value Qi with the lower limit value Qy outputted from the selection unit 44. As a result, when the addition value Qi2 is less than the lower limit value Qy, the lower limit value Qy is outputted and it becomes a new integral term output value Qi As a result, undershoot is prevented.

Then, integral term computation means 3 and correction means 4 find the addition value Qi2 by adding up the output value Qi1 obtained by multiplying the difference e by the prescribed integration constant Ki and the previous integral term output value Qi−1 and then limit the upper limit of the addition value Qi2 to a value (upper limit value Qx) obtained by adding a maximum limiting injection quantity Qm to a smaller of the differential term output value Qd or 0 and suppress the excess increase in the injection quantity. As a result, overshoot is prevented.

More specifically, correction means 4 comprises a selection unit 41 for selecting the smaller of the differential term output value Qd or 0, an addition unit 42 for adding the maximum limiting injection quantity Qm to the output value of the selection unit 41, and an upper limit limiter 43 for limiting the upper limit of the integral term output value Qi with the upper limit value Qx outputted from the addition unit 42. As a result, when the addition value Qi2 is larger than the upper limit value Qx, the upper limit value Qx is outputted and it becomes a new integral term output value Qi. As a result, overshoot is prevented.

Correction means 4 operates (controls the upper limit or lower limit of the addition value Qi2) when the engine and drive system are disconnected and the actual revolution speed En approaches the target revolution speed Eo within the prescribed value (for example, about 300–400 rpm). This is because if the upper limit or lower limit control with correction means 4 is conducted at all times, a good speed response inherent to the proportional integral control is impeded.

Correction means 4 terminates operation (control of the upper limit or lower limit of the addition value Qi2) and is reset when the difference e is inverted from plus to minus or from minus to plus. This is done to return the differential term output value Qd to the initial state when the difference e is inverted after the operation of correction means 4 because limiting with the differential term output value Qd has already become unnecessary.

The operation of the present embodiment based on the above-described configuration will be described below with reference to FIG. 6.

An example shown in the figure relates to the case in which the actual revolution speed En is brought down to the target revolution speed Eo at the time of revolution matching of a fully automatic transmission or a semiautomatic transmission in which a manual transmission is switched by mechanical operations.

First, an assumption is made that the clutch is disengaged. Then the control with correction means 4 is terminated and a typical proportional integral control is carried out till the actual revolution speed En approaches the target revolution speed Eo within the prescribed value Z (about 400 rpm). Thus, referring to FIG. 4, when the integral term output value Qi is found, the functions of all the elements constituting the correction means 4 are terminated and the addition value Qi2 is directly outputted without being upper limit controlled or lower limit controlled and becomes the integral term output value Qi. The final injection quantity Q is then found, as shown in FIG. 1, by using the integral term output value Qi. Thus, conducting the usual proportional integral control makes it possible to carry out control with excellent speed response till the actual revolution speed En approaches the target revolution speed Eo within the prescribed value Z.

However, if such a proportional integral control is continued after the actual revolution speed En has approached the target revolution speed Eo within the prescribed value Z, when the actual revolution speed En is brought down to the target revolution speed Eo, the difference e obtained by subtracting the actual revolution speed En from the target revolution speed Eo becomes negative. As a result, both the output value Qi1 shown in FIG. 4 and the previous value Qi−1 become negative and subtraction is continued in the process for computing the integral term output value Qi till the difference becomes 0. For this reason, at the point in time at which the difference becomes 0, the fuel injection quantity can become too small causing undershoot (the actual revolution speed En is less than the target revolution speed Eo). In the present embodiment, in order to prevent such an overshoot, the lower limit of the addition value Qi2 in the process for computing the integral term output value Qi is limited by the larger (Qy) of 0 or the differential term output value Qd, thereby preventing the fuel injection quantity from becoming too small.

This procedure will be explained hereinbelow with reference to FIG. 6. Before the actual revolution speed En approaches the target revolution speed Eo within the prescribed value Z, a value with an upper limit or lower limit which is not limited by-correction means 4 is used as the integral term output value Qi in the present embodiment (region A). Once the actual revolution speed En has thereafter dropped so as to become less than the prescribed value Z from the target revolution speed Eo, the lower limit of the addition value Qi2 in the process for computing the integral term output value Qi is limited by a larger of 0 and the differential term output value Qd. In the example shown in the figure, it is limited by 0 region B). If the actual revolution speed En then further decreases and the differential term output value Qd accordingly becomes more than 0, the lower limit of the addition value Qi2 in the process for computing the integral term output value Qi is limited by the differential term output value Qd rather than 0 (region C).

Once the lower limit of integral term output value Qi has been limited by the differential term output value Qd in the region C, the limited value thereof becomes the previous value Qi−1, as shown in. FIG. 4, and is successively integrated. The integral term output value Qi thus obtained is converged to a value matching the target revolution speed Eo, as shown in FIG. 6. Then, in point D, the integral term output value Qi becomes larger than the differential term output value Qd. Therefore it is meaningless to limit the lower limit of the integral term output value Qi based on the differential term output value Qd. Thus, in the present control when the integral term output value Qi prior to limiting is less than the differential term output value Qd, the lower limit of the integral term output value is limited to the differential term output value Qd or 0, thereby preventing the excess decrease in the injection quantity. Therefore, when the integral term output value Qi becomes larger than the differential term output value Qd, as in point D and thereafter, the control is not required. Therefore, in point D and thereafter, the differential term output value Qd may be reset to 0. In the example shown in the figure, the reset to 0 is made in point E (a point in which the difference e is inverted from negative to positive).

Figure 6:
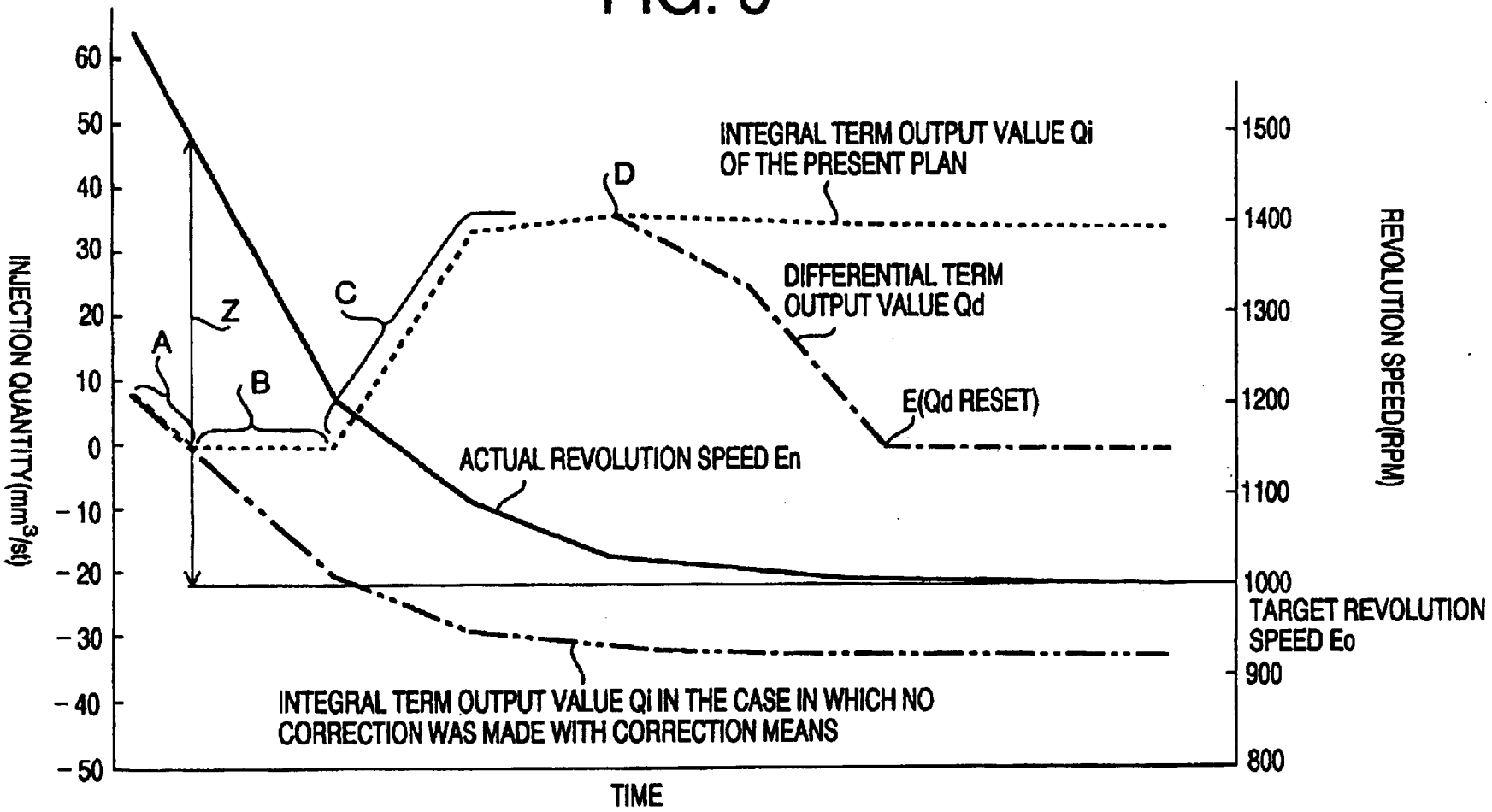
FIG. 6 is an explanatory drawing illustrating fluctuations of actual revolution speed caused by fluctuations of integral term output value (when revolution speed is decreased)

As described hereinabove; in the present embodiment, undershoot caused by the excess decrease in the quantity of injected fuel is suppressed by changing the integral term output value Qi between the regions A, B, C with correction means 4, as shown in FIG. 6. Saying the opposite, when the integral term output value Qi is not corrected with correction means 4, the integral term output values Qi are added up (negative addition) according to the difference e (negative value) and decrease successively. As a result, the quantity of injected fuel becomes too small with respect to the target revolution speed Eo and undershoot occurs.

Figure 7A:
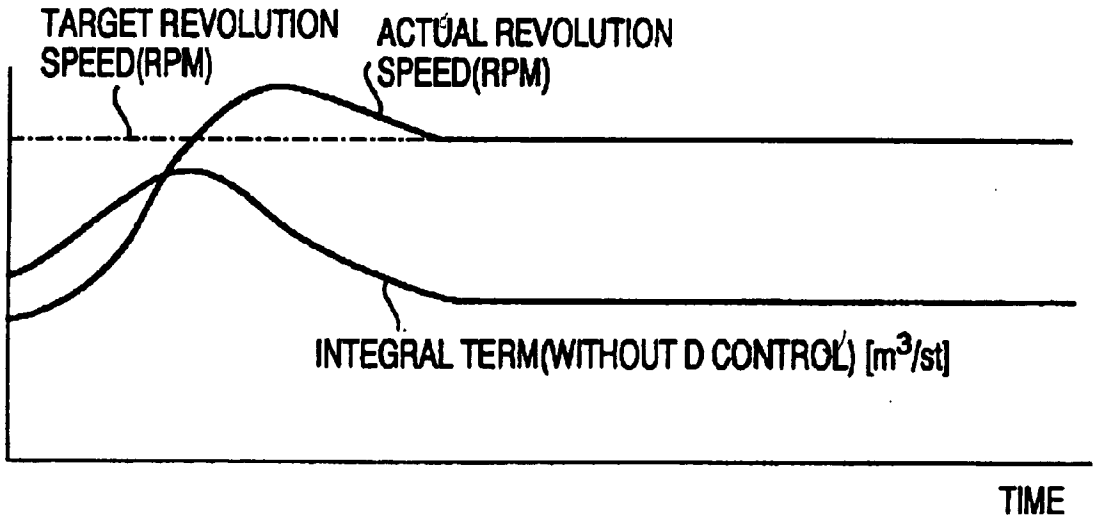
FIG. 7 is an explanatory drawing illustrating fluctuations of actual revolution speed caused by fluctuations of integral term output value (when revolution speed is increased).
Figure 7B:
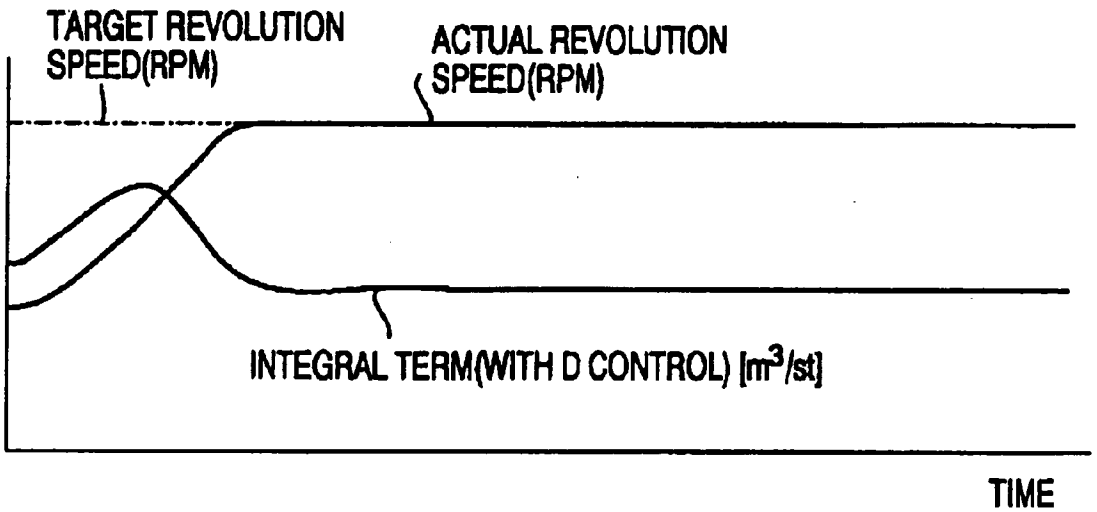

FIG. 7 illustrates the case in which the actual revolution speed En is increased to the target revolution speed Eo. FIG. 7*a* shows the fluctuations of actual revolution speed En in the case in which the upper limit of the integral term output value Qi is not limited based on the differential term output value Qd, and FIG. 7*b* shows the fluctuations of actual revolution speed En in the case (present embodiment) in which the upper limit of the integral term output value Qi was limited based on the differential term output value Qd with the correction means 4 shown in FIG. 4 (both cases are simulated). Comparison of the two cases shows that in the present embodiment overshoot can be suppressed for the same reasons for which the above described undershoot could be suppressed.

In the present embodiment, as shown in FIG. 2 and FIG. 5, the differential term output value Qd was computed based on the difference e between the target revolution speed Eo and the actual revolution speed En. However, when the target revolution speed Eo does not change dynamically (for example, in the case of idle engine revolution speed control, because the differential value of difference e and the differential value of actual revolution speed En become identical, the differential term output value Qd may be computed by using only the differential value of the actual revolution speed En.

As described hereinabove, with the fuel injection quantity control device in accordance with the present invention, when the actual revolution speed of the engine is controlled to the target revolution speed, overshoot and undershoot can be suppressed.

What is claimed is:

1. A fuel injection quantity control device for controlling an actual revolution speed of an engine to a target revolution speed, comprising:

difference computation means for subtracting the actual revolution speed from the target revolution speed and finding a difference therebetween;

proportional term computation means for multiplying the difference by a prescribed proportionality constant and finding a proportional term output value;

integral term computation means for finding an integral term output value which is obtained by integrating a product of the difference and a prescribed integration constant;

differential term computation means for finding a differential term output value which is obtained by multiplying a value obtained by differentiating the difference by a prescribed differentiation constant; and injection quantity computation means for adding up the proportional term output value and integral term output value and determining the injection quantity, wherein the fuel injection quantity control device further comprises:

correction means for limiting a lower limit of the integral term output value with the differential term output value when the difference is negative, thereby suppressing the excess reduction of the injection quantity, and limiting the upper limit of the integral term output value with the differential term output value when the difference is positive, thereby suppressing the excess increase of the injection quantity.

2. The fuel injection quantity control device according to claim 1, wherein the correction means limits the lower limit or upper limit of the integral term output value with the differential term output value when the engine and a drive system are disconnected and the actual revolution speed approaches the target revolution speed within the prescribed value.

3. The fuel injection quantity control device according to claim 1, wherein the correction means discontinues limiting the lower limit or upper limit of the integral term output value with the differential term output value and resets the differential term output value to zero when the difference changes from positive to negative or from negative to positive.

4. The fuel injection quantity control device according to claim 2, wherein the correction means discontinues limiting the lower limit or upper limit of the integral term output value with the differential term output value and resets the differential term output value to zero when the difference changes from positive to negative or from negative to positive.

5. The fuel injection quantity control device according to claim 1, wherein the correction means discontinues limiting the lower limit of the integral term output value with the differential term output value and resets the differential term output value to zero when the integral term output value becomes larger than the differential term output value.

6. The fuel injection quantity control device according to claim 2, wherein the correction means discontinues limiting the lower limit of the integral term output value with the differential term output value and resets the differential term output value to zero when the integral term output value becomes larger than the differential term output value.

7. The fuel injection quantity control device according to claim 1, wherein the correction means discontinues limiting the upper limit of the integral term output value with the differential term output value and resets the differential term output value to zero when the integral term output value becomes smaller than the differential term output value.

8. The fuel injection quantity control device according to claim 2, wherein the correction means discontinues limiting the upper limit of the integral term output value with the differential term output value and resets the differential term output value to zero when the integral term output value becomes smaller than the differential term output value.

9. The fuel injection quantity control device according to claim 1, wherein the correction means limits the lower limit of the integral term output value with a lower limit value determined by comparing the differential term output value with zero and selecting the larger of them.

10. The fuel injection quantity control device according to claim 2, wherein the correction means limits the lower limit of the integral term output value with a lower limit value determined by comparing the differential term output value with zero and selecting the larger of them.

11. The fuel injection quantity control device according to claim 1, wherein the correction means limits the upper limit of the integral term output value with an upper limit value determined by comparing the differential term output value with zero and selecting the smaller value of them.

12. The fuel injection quantity control device according to claim 2, wherein the correction means limits the upper limit of the integral term output value with an upper limit value determined by comparing the differential term output value; with zero and selecting the smaller value of them.

13. The fuel injection quantity control device according to claim 1, wherein the proportional term computation means determines the proportionality constant based on the difference and water temperature.

14. The fuel injection quantity control device according to claim 2, wherein the proportional term computation means determines the proportionality constant based on the difference and water temperature.

15. The fuel injection quantity control device according to claim 1, wherein the integral term computation means successively adds up the present integral term output value obtained by multiplying the difference by the prescribed integration constant and the next integral term output value found in a similar manner.

16. The fuel injection quantity control device according to claim 2, wherein the integral term computation means successively adds up the present integral term output value obtained by multiplying the difference by the prescribed integration constant and the next integral term output value found in a similar manner.

17. The fuel injection quantity control device according to claim 1, wherein the integral term computation means determines the integration constant based on the difference and water temperature.

18. The fuel injection quantity control device according to claim 2, wherein the integral term computation means determines the integration constant based on the difference and water temperature.

19. The fuel injection quantity control device according to claim 1, wherein the differential term computation means determines the differentiation constant based on the difference.

20. The fuel injection quantity control device according to claim 2, wherein the differential term computation means determines the differentiation constant based on the difference.

* * * * *